US008308868B2

(12) United States Patent
Davis et al.

(10) Patent No.: US 8,308,868 B2
(45) **Date of Patent: *Nov. 13, 2012**

(54) ARTIFICIAL FIELD LITTER PICK-UP DEVICE

(75) Inventors: Michael E. Davis, Indianapolis, IN (US); John Kitterman, Fortville, IN (US)

(73) Assignee: GreensGroomer WorldWide, Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/249,283

(22) Filed: Sep. 30, 2011

(65) Prior Publication Data

US 2012/0017939 A1 Jan. 26, 2012

Related U.S. Application Data

(62) Division of application No. 12/275,477, filed on Nov. 21, 2008, now Pat. No. 8,209,809.

(60) Provisional application No. 61/021,752, filed on Jan. 17, 2008.

(51) Int. Cl.
*B08B 7/00* (2006.01)

(52) U.S. Cl. ..... 134/6; 134/42

(58) Field of Classification Search ..... None
See application file for complete search history.

(56) References Cited

U.S. PATENT DOCUMENTS

| | | | | |
|---|---|---|---|---|
| 3,377,641 | A * | 4/1968 | McGregor | 15/105 |
| 5,032,188 | A * | 7/1991 | Kettle et al. | 134/38 |
| 2004/0159667 | A1* | 8/2004 | Rogers et al. | 221/251 |
| 2008/0060151 | A1* | 3/2008 | Heitfield | 15/82 |
| 2010/0037419 | A1* | 2/2010 | de Bree | 15/347 |

FOREIGN PATENT DOCUMENTS

| | | | |
|---|---|---|---|
| JP | 2000-175563 | A | 6/2000 |
| JP | 2002-514957 | A | 5/2002 |
| KR | 10-1999-0068396 | A | 9/1999 |

* cited by examiner

*Primary Examiner* — Michael Kornakov
*Assistant Examiner* — Nicole Blan
(74) *Attorney, Agent, or Firm* — Woodard, Emhardt, Moriarty, McNett & Henry LLP

(57) ABSTRACT

A device for cleaning an artificial "infill turf" field includes a rotating brush assembly and a basket for receiving waste and infill material. The basket has a bottom with openings that allow infill material to be returned to the field, and a vibrator to promote separation of infill from waste. The device may include wheels connected to the brush assembly in a manner effective to rotate the brush when one or both of the wheels rotate, and a magnet for picking magnetic waste material from the field. The device may include an actuator for adjusting the height of the brushes, and a tow bar that allows the device to be positioned in an "active" orientation to sweep a field, or an "uplifted" orientation to transport the device across curbs or rough terrain. Multiple brushes and/or baskets may be provided.

13 Claims, 4 Drawing Sheets

ARTIFICIAL FIELD LITTER PICK-UP DEVICE

REFERENCE TO RELATED APPLICATION

This application is a divisional of U.S. patent application Ser. No. 12/275,477, filed Nov. 21, 2008, now U.S. Pat. No. 8,209,809 which claims the benefit of U.S. Provisional Application No. 61/021,752, filed Jan. 17, 2008, which is hereby incorporated by reference.

FIELD OF THE DISCLOSURE

The present invention relates generally to devices for automatically removing litter from a field, and more particularly to devices for picking up litter from an artificial field and returning infill material to the field.

BACKGROUND OF THE INVENTION

High-performance, artificial athletic fields are increasingly being installed and used in communities across the United States. Many of these fields are "infill turf systems" in which blades of synthetic grass are tufted into a backing system that is covered with a deep layer of sand and/or synthetic particles (the infill material). The infill material is often made of small particles of rubber or plastic, which fills the spaces between the fibers (blades of "grass") to hold the fibers up and to provide a cushioned surface.

To maintain these artificial athletic fields it is desirable to remove litter from the field after sporting events and the like, and to otherwise clean and groom the field. There are various devices and methods of removing litter from an artificial field, but many of these devices and methods undesirably collect infill material as the device is moved across the artificial field, with no effective manner or method of returning the infill material to the artificial field. Additionally, many of these devices are ineffective or incapable of removing ferrous material from the artificial field. Further, many of these devices lack inclining and/or tilting capabilities, which is often desirable due to changing field conditions.

Accordingly, a need exists for a device that cleans synthetic infill turf surfaces while allowing infill material that is picked up during the cleaning process to be returned to the field. A need also exists for a device that cleans synthetic infill turf surfaces of ferromagnetic material that may not be picked up by common brush-type cleaning systems. A need also exists for a device that is easily adjustable in height and orientation to allow the device to be used on surfaces that may have varying blade heights and/or surface slopes. The present invention addresses these needs.

SUMMARY OF THE INVENTION

In one aspect of the present invention there is provided a device for cleaning an artificial grass/particulate infill sports field. The device comprises a rotating brush assembly and a container for receiving waste material from the brush. The brush assembly picks up waste and some particulate infill material from the field and deposits it in the container. The container has a bottom with openings sized to allow infill material to be returned to the field while retaining waste material. A vibrator effective for causing the container bottom to vibrate to promote separation of particulate infill material from waste may also be included.

The device may also include one or more wheels that are functionally connected to the brush assembly such that rotation of the wheel(s) causes the brush assembly to rotate. The device may also include a magnet sized and positioned to attract and hold magnetic waste material from a field.

The device may also include an actuator effective for adjusting the height of and/or for tilting the device. A tow bar effective for positioning the device in either an "active" or a "lifted" orientation may also be provided.

In some embodiments the device includes two brush assemblies, with each brush assembly being attached to a different wheel. In this embodiment both wheels may be used to power the brushes even the wheels are not rotating at the same rate—such as when the device is turning.

DESCRIPTION OF PREFERRED EMBODIMENTS

Figure 1:
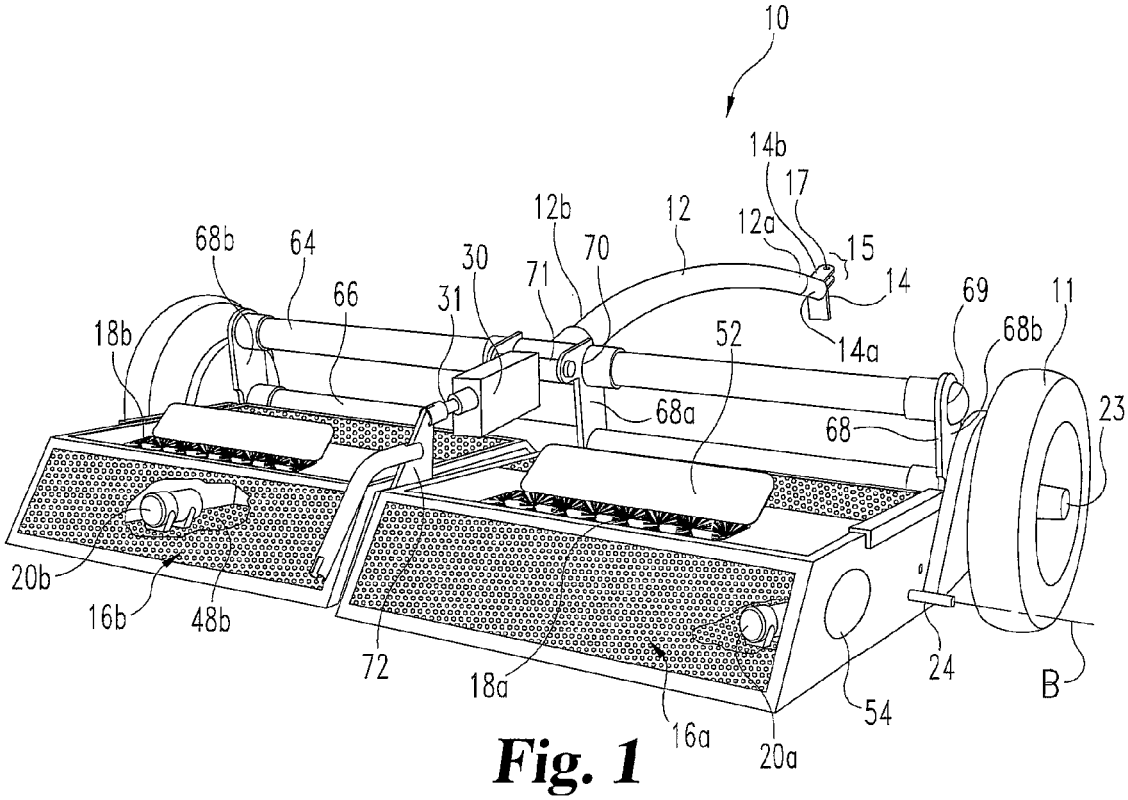
FIG. 1 is a perspective view of the artificial field litter pick-up device of the present invention according to one embodiment.

For the purposes of promoting an understanding of the principles of the disclosure, reference will now be made to certain embodiments and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

As previously indicated, the present invention provides a litter pick-up device for use on synthetic infill turf fields. Such fields typically are made of synthetic blades of grass which are tufted into a backing system. That synthetic grass layer is filled with a layer of synthetic particles (the infill material) which fills the spaces between the blades to hold the blades up and to provide a cushioned surface. The device "sweeps" the field of debris and a small amount of infill material, and returns the infill material back to the field.

In one embodiment the device includes at least one rotating brush to pick-up debris from the field. The rotating brush may be mounted on a brush axle such that rotation of the axle rotates the brush. In some embodiments the brush is cylindrical with a diameter of six to twelve inches, although larger or smaller brushes may be used. The brush may have a length of between about 18 and 72 inches, although here too larger or smaller sizes may be used. In one preferred embodiment the brush has a diameter of about 10 inches, and a length of about 36 inches.

The brush may be made of wire or any material that is strong and stiff enough to pick up trash like candy wrappers, athletic tape, plastic bottle tops, aluminum can tabs, sunflower seeds hulls, etc., from an athletic field.

The device also includes a container portion (optionally referred to as a basket, etc.) for receiving waste material from the brush. The container portion preferably has at least a bottom wall and a plurality of side walls. Openings effective for allowing infill material to pass through the container are provided in the bottom of the container. Such openings may be referred to as holes, perforations, apertures, etc, and may vary in number and location. In general though, the openings are sized and positioned to allow infill material to pass through the container bottom while retaining material larger than the infill. This allows the infill material to be returned to the field while collecting the waste material in the container.

The device may also include a vibrator effective for causing the container bottom to vibrate to promote separation of particulate infill material from waste contained in the basket. The vibrator may be controlled by a simple ON/OFF switch, or it may be remotely controlled. The vibrator is preferably a standard electric vibrator such as a 12 Volt vibrator Model DC 50 manufactured by Vibco.

The device also preferably includes one or more wheels to facilitate pulling the device across a field. Preferably at least one pair of wheels is included, with the wheels being mounted on a wheel axle. In some embodiments the wheels are connected to the brush assembly such that rotation of one or both of the wheels causes the brush to rotate. For example, a wheel may be connected to the brush assembly by attaching a sprocket to the wheel, a sprocket on the brush assembly, and chain connection that rotates the brush when the wheel rotates.

The device may also include a magnet sized and positioned to attract and hold magnetic waste material from a field. The magnet may be positioned in front of, above, or behind the brush and/or the waste basket. The strength, dimensions, etc., of the magnet may be varied according to the needs of the user.

The device may also include an actuator effective for adjusting the height of and/or for tilting the device. The actuator may be used to tilt the device when not in use and/or to adjust the relative operating height of the brushes relative to the artificial field. Accordingly, the actuator may push the brush assembly lower so that it picks up more material from the field, or it may pull the brush assembly upwards so that it picks up less, or even no, material from the field.

The device may also include a tow bar for pulling the device with a cart or small tractor. In some embodiments the tow bar is adapted to allow the device to be pulled in either of two orientations—one orientation with the tow bar positioning the device in its normal "active" or "cleaning" orientation, and a second orientation with the tow bar positioning the device in a "lifted" orientation. The "lifted" orientation is particularly useful when the device is to be pulled over curbs, etc. For example, the tow bar may be curved so that when the device is hitched to a vehicle with the tow bar curved downward the device is positioned in its normal "cleaning" orientation, while when the device is hitched to a vehicle with the tow bar curved upward the device is tilted significantly upward. In this "lifted" orientation the under carriage of the device is held up and out of the way to prevent damaging the device when pulling it over rough terrain. In some embodiments the "lifted" orientation holds the brush assembly at least four inches above the ground, and more preferably holds the brush assembly at least six inches above the ground when the device is at rest on a flat surface.

In some embodiments the device includes two brush assemblies. The use of a two brush assemblies allows both of the wheels to be used to power the brushes, particularly when the device is turning. Since the wheels rotate at different rates when the device is making turns in the field, connecting both of the wheels to a single brush would put stress on the brush as the two wheels attempted to rotate the brush at different rates. With multiple brushes, each wheel may rotate one brush independently of the speed of rotation of the other brush. This allows the wheels to rotate at different rates, such as when turning the device, while still using both wheels to power the brush(es).

A second waste container may also be provided in the "two brush" embodiments so that each brush assembly has its own waste container. In other embodiments a plurality of additional brushes and/or baskets may be used.

Referring now to the drawings, FIG. 1 shows one embodiment of litter pick-up device 10. The device includes two side-by-side containers or baskets 16*a* and 16*b* with rotating brushes 18*a* and 18*b* to pick up litter left on an artificial field. Baskets 16*a* and 16*b* have openings (in this case, perforations) in their fronts, rears, and bottoms to allow infill material picked up by brushes 18*a* and 18*b* to pass through the baskets and back onto the artificial field.

A wheel 11 is provided on a wheel axle 23 to facilitate pulling the device over a sports field. A tow bar 12 with hitch 14 to attach the device to a towing vehicle is provided.

In the illustrated embodiment, device 10 includes vibrators 20*a* and 20*b* to vibrate basket bottoms 48*a* and 48*b*, respectively, to encourage the infill material to pass through the perforations and back onto the artificial field. The vibrators may be selectively activated to allow one or both of the baskets to retain infill material if desired.

Device 10 also includes an actuator 30 to tilt or incline the device as desired. The actuator allows the height of the brush (es) to be controlled relative to the field, so that the operator may control how aggressively the brushes clean the field. When the brushes are positioned lower in the field the amount of material picked up by the brushes is greater. When the brushes are positioned higher relative to the filed, a lesser amount of material (or even no material at all) is picked up by the brushes.

Illustrated brushes 18*a* and 18*b* extend radially from, and are mounted on, rotating brush axle(s) 24 extending along a brush axis B across the width of device 10. In the illustrated embodiment, brushes 18*a* and 18*b* have a brush diameter of 10 inches defining a center hole with a diameter of one inch for passage of the rotating brush axle. In the illustrated embodiment, device 10 is about seventy-two inches in width, along brush axis B. Brushes 18 and/or the rotating brush axle may be sized larger or smaller if desired.

Illustrated brushes 18*a* and 18*b* are ground-driven based on rotation of wheels 11 to pick up litter off the artificial field. Wheels 11 are mounted to a wheel frame or axle extending therebetween. The rotating axle on which brushes 18*a* and 18*b* are mounted are mechanically connected with wheels 11 and/or the wheel axle via a sprocket 19 and chain 21 connection; however, other mechanical connections are contemplated to drive brushes 18, including mechanical gears as an example. In the illustrated embodiment, sprockets 19*a* and 19*b* cooperate with chain 21 to rotate brush axle 24, thus rotating brushes 18, in response to rotation of wheels 11.

In certain embodiments, the rotational ratio between brushes 18 and wheels 11 is between 2:1 and 8:1, and preferably about 3:1. It should be appreciated that the components can be configured and connected differently such that the ratio is higher or lower, as desired. Additionally, a gear assembly (for example, such as is used on bicycles) may be included to allow the rotational ratio to be changed as needed.

Brushes 18 may be composed of a synthetic material, such as nylon as an example; however, it should be appreciated that the brushes may be composed of other appropriate materials. Additionally, the rotating brush axle may be composed of a lightweight aluminum material, as an example, or another such appropriate material. Brushes 18 transfer the litter to the container baskets 16.

Regarding the side-by-side baskets 16*a* and 16*b*, in the preferred embodiments the configuration and description of each of the baskets applies equally to the other. However, it should be appreciated that in other embodiments the device may include a single litter basket/brush combination, or alternatively more than two baskets with brushes.

Figure 5:
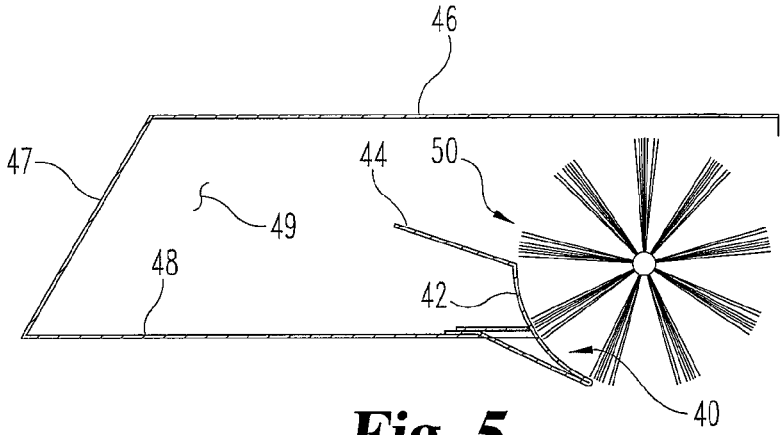
FIG. 5 is side section view of a portion of the artificial field litter pick-up device of the present invention according to one embodiment.

Referring specifically to FIG. 5, each basket 16 includes a top wall 46, an opposite bottom wall 48, side panels 49, a back wall 47 and an opposite front opening 50 where brush 18 is positioned. In the illustrated embodiment, top and bottom walls 46 and 48 are generally parallel, with back wall 47 inclined between the top and bottom walls. Additionally, baskets 16 each may optionally include an access door 52 and a scoop assembly 40.

As illustrated, scoop assembly 40 includes at least a curved scooping surface 42 and a displacement surface 44. Scoop assembly 40 is welded to bottom wall 48 of basket 16 adjacent brush 18, such that the litter is pushed along surface 42 up to surface 44 to be transferred into the interior of basket 16. In certain embodiments, device 10 is configured such that the bottom of curved surface 42 of scoop assembly 40 travels about one-eighth of an inch above the artificial field.

The walls of baskets 16 may include holes or perforations to allow infill material collected by brushes 18 and transferred into baskets 16 to pass out of the baskets and back onto the artificial field. As noted above, at least bottom walls 48 preferably include such perforations, with perforations in top walls 46 and back walls 47 being optional. In other embodiments, walls 46, 47 and 48 all include the perforations and the perforations are staggered with respect to each other across the walls to provide maximum coverage.

In the illustrated embodiment, walls 46, 47 and 48 include perforations or holes having diameters of 0.1875 inches and staggered at 0.25 inches. However, it is contemplated that the size and staggering of the perforations can be configured differently, such that the perforations maintain a relatively even distribution of infill material over the artificial field.

Access door 52 may be hingably mounted to top wall 46. In the illustrated embodiment, the hinge is welded to basket 16. Access door 52 allows access to the interior of basket 16 to remove litter and other debris that has collected within basket 16, and/or to provide maintenance to basket 16.

Figure 2:
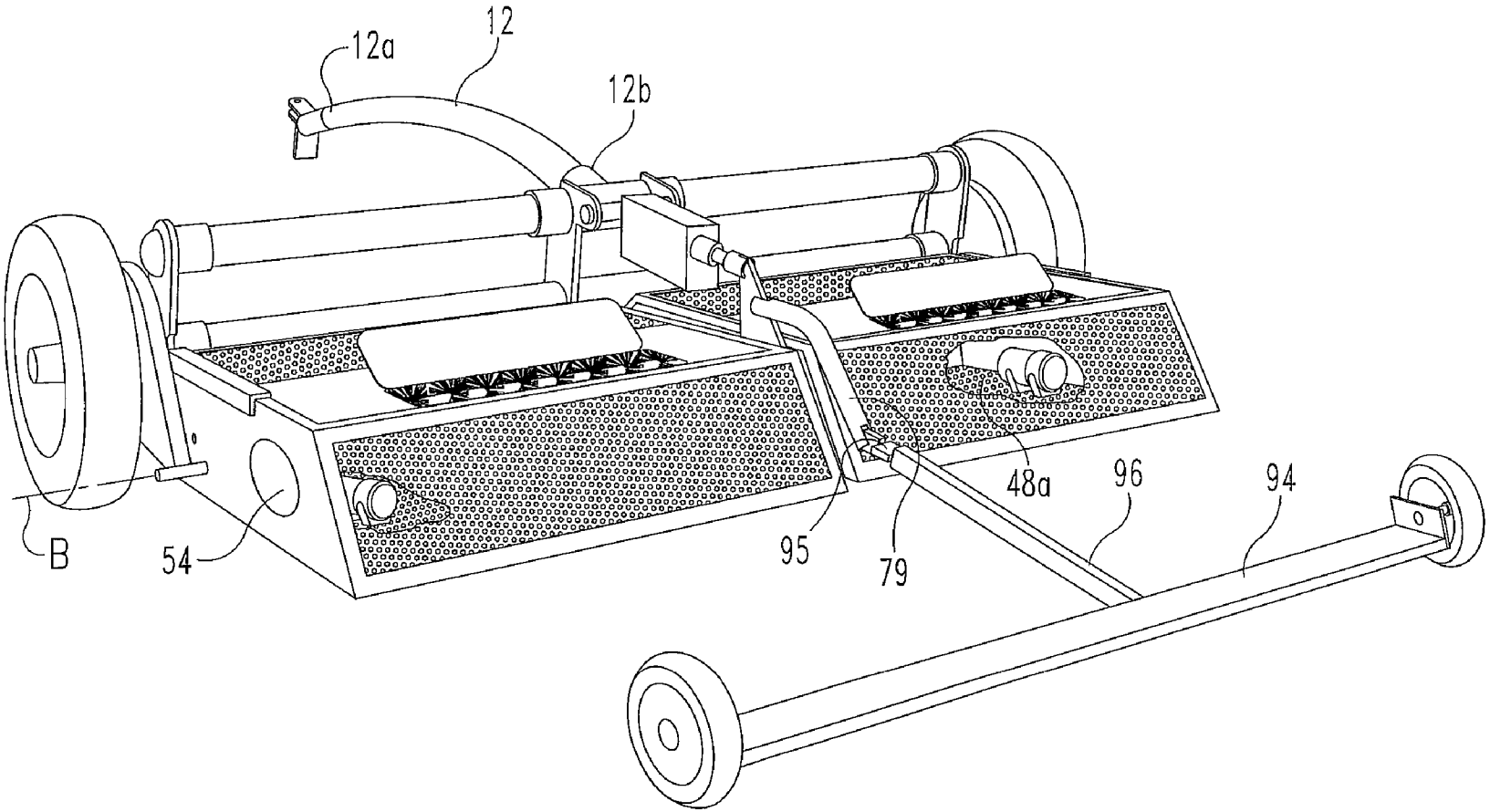
FIG. 2 is a perspective view of the device illustrated in FIG. 1, with a magnet assembly attached.

Additionally, each basket 16 may optionally include an access hole 54 defined in the outer side panel 49, as best illustrated in FIGS. 1 and 2. Access holes 54 provide another manner of entry into the interior of baskets 16 to remove litter collected therein. In the illustrated embodiment, each access hole 54 is circular in shape with a diameter of five inches. However, it is contemplated that hole 54 may be configured and sized differently.

The components of baskets 16 may be composed of lightweight aluminum material. However, it is contemplated that the components may be composed of various other suitable materials. Further, baskets 16 may be selectively removable from device 10 to remove litter or debris from the interiors of the baskets, or to otherwise provide maintenance to the baskets.

Device 10 preferably includes one or more vibrators 20 to vibrate the container bottom to facilitate separation of waste from infill material. In the most preferred embodiments one vibrator is mounted within each basket 16. When activated, vibrators 20 provide vibratory movement to baskets 16 to encourage infill material that has collected within baskets 16 to pass through the perforations in the walls of the baskets and back onto the artificial field.

As previously disclosed, vibrators 20 may be mounted within the interior of baskets 16 at locations which are easily accessible via access doors 52. Vibrators 20 each typically include an ON/OFF switch to control the power to the vibrator. Further, device 10 includes one or more electrical cables providing electrical power to vibrators 20. In certain embodiments, the one or more cables connect with the battery of the towing vehicle. Additionally, vibrators 20 may be remote controlled by a user via a remote control device. The vibrators used within device 10 may be typical or standard vibratory machines. An example of such is a 12 Volt vibrator Model DC 50 manufactured by Vibco.

The framing of device 10 generally consists of parallel bars extending across the width of the device, at least partially supporting the components of the device. In the illustrated embodiment, device includes an upper bar 64 and a lower bar 66, connected together in parallel via tube hangers 68. Upper bar 64 connects with tow bar 12. Additionally, lower bar 66 connects with brackets which help support brushes 18 mounted on the rotating brush axle. In certain embodiments, lower bar 66 is the rotating wheel axle extending between wheels 11. Upper bar 64 and lower bar 66 may be single, unitary bars extending across the width of device 10, or each may consist of two separate bars connected together at or near the center of device 10. Bars 64 and 66 may be composed of a lightweight aluminum material, or another such appropriate material as desired. Further, in the illustrated embodiment, bars 64 and 66 are each circular in shape with a diameter of three inches; however, the bars can be configured and sized differently as desired.

Tube hangers 68 consist of two inner hangers 68*a* and two outer hangers 68*b*, as best illustrated in FIG. 1. Tube hangers 68 define holes 69 configured for passage of upper and lower bars 64 and 66. Inner hangers 68*a* further define a hole 70 configured for passage of a center T-bar 71 on which an actuator is mounted, as will be discussed in greater detail below. In the illustrated embodiment, upper bar 64 connects with tow bar 12 at a location between inner tube hangers 68*a*.

A center bracket 72 and two end plates engage with lower bar 66 and the rotating brush axle to provide support to brushes 18. The end plates are each positioned outwardly of baskets 16, between wheel 11 and side panel 49. Each end plate defines at least a larger hole for passage of lower bar 66 and a smaller hole for passage of the rotating brush axle. The sprocket 19 and chain 21 connections engage the rotating brush axle adjacent the end plates, as shown in FIG. 1.

Center bracket 72 is positioned between the two baskets 16. Bracket 72 defines at least a larger hole for passage of lower bar 66 and a smaller hole for passage of the rotating brush axle. Additionally, center bracket 72 includes a mast portion extending above baskets 16 to connect with an extension arm of the actuator. Center bracket 72 and the end plates may define additional holes for mounting and/or connecting with various other components.

Device 10 may also additionally include bumpers to protect the device from bumps and scrapes with obstacles on the field. Such bumpers may be composed of an engineering plastic, such as polyoxymethylene as an example, commonly known as Delrin manufactured by DuPont. The bumpers may also be composed of an ultra high molecular weight material. However, it should be appreciated that bumpers can be composed of other appropriate materials as desired.

Device 10 further includes an actuator 30 to provide inclination or tilting to device 10. It may be desirable to tilt the device when not in use and/or to adjust the relative operating distance of brushes 18 above the artificial field. In the illustrated embodiment, actuator 30 is fixedly mounted to T-bar 71 at one end. At the other end, the actuator includes an extension arm 31 mounted to mast portion 79 of center bracket 72. However, it should be appreciated that actuator 30 can be mounted at other locations on device 10 such that actuator 30 provides the desired tilting and inclining effect to the device. Upon activation by a user, actuator 30 is operable to tilt device 10 rotationally about, and/or relative to, lower bar 66. More specifically, extension arm 31 can be extended outward from and pulled inward toward the body of actuator 30, thereby moving center bracket 72 accordingly. The rigid mounting of center bracket 72, baskets 16, and the rotating brush axle causes at least those components to tilt or incline when actuator 30 is activated.

Actuator 30 may include a typical power switch, such as "rocker" switch generally known in the art. In certain embodiments, actuator 30 may be controlled remotely by a user via a remote control device. Actuator 30 may be a standard or typical electromechanical actuator. In certain embodiments, actuator 30 is a standard 12 Volt electromechanical actuator having an inner worm gear arrangement. An example actuator is model Electrak Pro Series, part number PR1205-4A65-04SCS RMA5045138, manufactured by Thomson. To provide power to actuator 30, device 10 may include an electric cable extending between actuator 30 and the battery source of the towing vehicle. In certain embodiments, a single electrical cable extends to both vibrators 20 and actuator 30 from the battery of the towing vehicle to provide power to all the components. In other embodiments, separate electrical cords extend to each of the components requiring an electrical power supply.

Optionally, device 10 may include a magnet assembly 94, as illustrated in FIG. 2, towed behind baskets 16 to collect ferrous materials on the artificial field. To connect magnet assembly 94 with device 10, a connector 95 may be engaged with mast portion 79 of center bracket 72. Connector 95 may be a "beaver tail" type connector, as is commonly known in the art, or another appropriate type of connecting device. A towing bar or extension arm 96 extends from connector 95 to magnet 94. In certain embodiments, arm 96 is about four feet in length. Additionally, magnet 94 may be positioned to travel about three inches above the artificial field. However, it should be appreciated that these parameters may be altered as desired. As magnet 94 travels over the artificial field, the magnet attracts ferrous materials on the field so that the ferrous materials cling to the magnet. Thereafter, magnet 94 may be cleaned to remove and discard the ferrous materials.

Tow bar 12 with hitch 14 extends from device 10 to the towing vehicle to enable device 10 to travel over an artificial field to pick up litter. Bar 12 includes a proximal end 12*a* for attachment with hitch 14 and a distal end 12*b* for attachment with upper bar 64. In the illustrated embodiment, bar 12 is composed of a lightweight aluminum material, is arcuate in overall shape, and is three inches in diameter. Additionally, in the illustrated embodiment, hitch 14 includes a channel member 14*a* and a flanged member 14*b*. At least a portion of flanged member 14*b* is configured to be slidably received within channel member 14*a*, such that member 14*b* can slide relative to member 14*a*. Channel member 14*a* may be welded to proximal end 12*a* of tow bar 12. Flanged member 14*b* includes a pair of flanges 15 to receive therebetween a flange of the towing vehicle's hitch component, the flange members defining holes 17 to receiving a locking hitch pin or other type of fastener. In the illustrated embodiment, a user may slide member 14*b* within and relative to member 14*a* to adjust the height of the hitch-engagement with the towing vehicle relative to tow bar 12 and the remainder of device 10. The user may align the holes in the members at the selected height location and lock the hitch in place via a hitch pin or other type of fastener.

Figure 3:
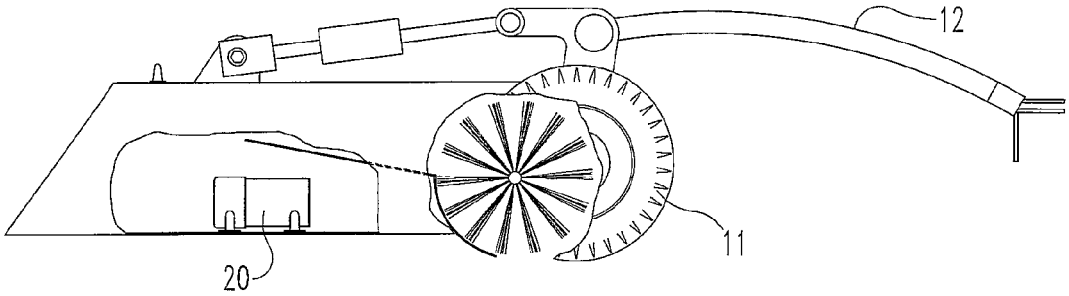
FIG. 3 is a side elevation of another embodiment of the artificial field litter pick-up device of the present invention.
Figure 4:
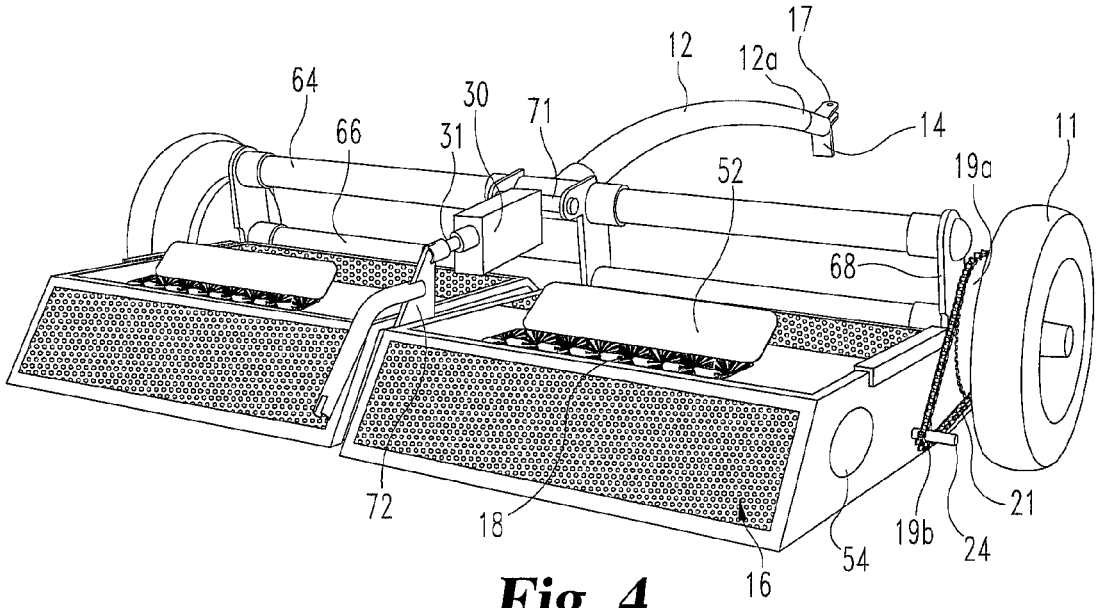
FIG. 4 is a perspective view of another embodiment of the artificial field litter pick-up device of the present invention.

The tow bar is preferably adapted to position the device in either of two orientations when the device is hitched to a vehicle. In one orientation the device is positioned in its "active" or "cleaning" orientation as shown in FIGS. 1-3. In a second orientation the device is positioned in its "lifted" orientation to allow transport over curbs, etc., without damaging the underside of the device.

To operate the device it is preferably attached to a vehicle using the tow bar 12. When the tow bar is positioned in a first orientation, as shown in FIGS. 1-4, the device it positioned in its normal "active" or "cleaning" orientation. In that orientation the brush(es) may contact the field and sweep waste therefrom. As the device is pulled across a field the wheels turn—thereby turning the brushes. When the device is turned to the right, the left wheel rotates faster than the right wheel and the left brush accordingly rotates faster than the right brush. When the device is turned to the left, the right wheel rotates faster than the left wheel and the right brush accordingly rotates faster than the left brush. Upon rotation of the wheels and the brushes, waste is brushed upwards into the container(s). Depending on the height of the brushes, infill material may also be brushed into the device. When the vibrator is activated the bottom of the container vibrates to facilitate separation of waste from infill material. The smaller sized infill material is then free to pass through the openings in the container bottom and to be returned to the field. The larger waste material does not pass through the openings and is retained by the device.

Figure 6:
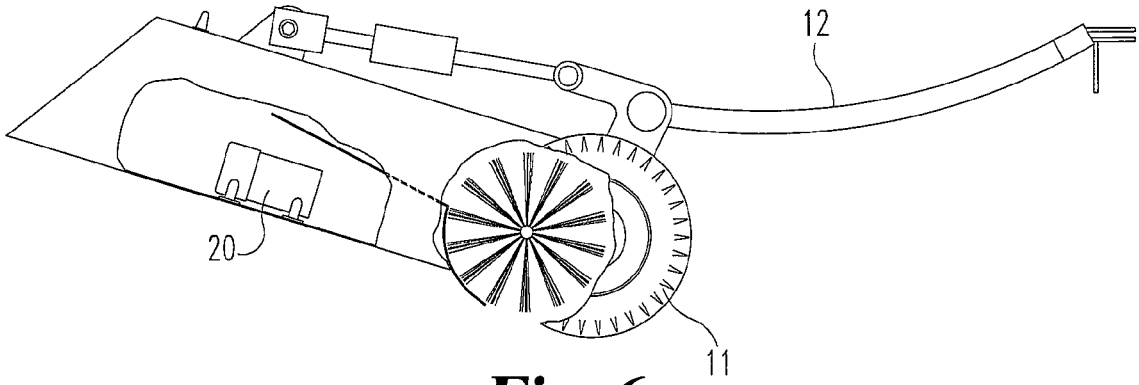
FIG. 6 is a perspective view of another embodiment of the artificial field litter pick-up device of the present invention.

To transport the device it may be hauled on a trailer, or it may be attached to a vehicle in a second orientation with the tow bar positioning the device in an "uplifted" orientation as shown in FIG. 6. That orientation is particularly useful when the device is to be moved a short distance, but may be pulled over curbs, etc. In the "uplifted" orientation the under carriage of the device is held up and out of the way to prevent damaging the device when pulling it over rough terrain.

While the disclosure has been illustrated and described in detail in the drawings and foregoing description, the same is to be considered as illustrative and not restrictive in character, it being understood that only the illustrated embodiments have been shown and described and that all changes and modifications that come within the spirit of the disclosure are desired to be protected.

What is claimed is:

1. A method of collecting waste material from a field having artificial grass and particulate infill material; the method comprising:

a) providing a field cleaning device comprising:

i) a brush assembly comprising a rotatable brush;

ii) a container having a bottom and at least one side wall, wherein said container is positioned to receive material that is picked up by the brush when the brush rotates, and further wherein said container includes openings in its bottom, said openings being sized and positioned to allow infill material to pass therethrough while retaining waste material; and iii) a vibrator for causing said container to vibrate to promote separation of particulate infill material from waste;

b) moving said field cleaning device over a field in a manner effective to cause the brush to rotate to move waste and infill material from the field surface to the container; and c) causing the vibrator to vibrate the container to facilitate passage of infill material therethrough while retaining waste material and wherein:

the field cleaning device includes at least one wheel connected to said brush assembly such that rotation of the wheel causes the brush to rotate, wherein said brush assembly is a first brush assembly, and wherein said wheel is a first wheel; and further wherein the device includes a second brush assembly; and further wherein the device includes a second wheel, wherein said second wheel is connected to said second brush assembly such that rotation of the second wheel causes the second brush to rotate; and further wherein said "moving said field cleaning device" comprises rotating said second wheel at rate different than the rate of rotation of said first wheel such that the second brush rotates at a speed different than the speed of rotation of the first brush.

2. The method of claim 1 wherein the container of the field cleaning device has openings that provide a nominal sieve opening of between 0.150 inches and 0.250 inches.

3. The method of claim 1 wherein said wheel is connected to said brush by a sprocket and chain connection.

4. The method of claim 1 wherein the field cleaning device includes a magnet sized and positioned to attract and hold magnetic waste material from a field.

5. The method of claim 1 wherein the field cleaning device includes an actuator effective for adjusting the height of and/or for tilting the device.

6. The method of claim 1 wherein the field cleaning device includes a second container having a bottom and at least one side wall, wherein said second container is positioned to receive waste and infill material from an artificial field upon rotation of said second brush, and further wherein said second container includes openings in its bottom to allow passage of infill material therethrough while retaining waste material.

7. The method of claim 6 wherein the field cleaning device includes a second vibrator for causing the second basket to vibrate to promote separation of particulate infill material from waste contained in said second basket; and further including the step of causing the second vibrator to vibrate the second basket to facilitate passage of infill material therethrough while retaining waste material.

8. The method of claim 1 wherein the field cleaning device includes a tow bar adapted to allow the device to be attached to a vehicle in either of two orientations; wherein a first of said two orientations positions the brush assembly in a position effective to sweep a field, and wherein a second of said two orientations positions the brush assembly in an uplifted position wherein the brush assembly is held at least four inches above the ground; and wherein the method includes pulling the field cleaning device by its tow bar with the device attached to a vehicle in its first orientation to clean a field, and additionally pulling the field cleaning device by its tow bar in its second orientation to wherein the device is transported over rough terrain without the terrain contacting the brush assembly.

9. A method of removing litter from a field comprising the steps of:

providing a vehicle having a first wheel and a second wheel to support the vehicle atop a field with the vehicle having a first brush rotatably mounted thereon being connected to the first wheel and engagable with the field, the vehicle further having a container to hold litter;

positioning a first brush on a vehicle in contact with a field having litter thereon;

moving the vehicle horizontally across the field;

rotating the first brush at a first rotational speed depending on the rotation of the first wheel sweeping litter off the field as the vehicle moves thereacross;

rotating the brush past a container to scrape and deposit litter on the brush into the container;

vibrating the container to separate litter according to a specified size;

allowing litter to move against a perforated wall of the container;

allowing litter equal or less than the specified size to pass through the perforated wall;

retaining litter in the container having a size greater than the specified size;

providing a second brush rotatably mounted on the vehicle and connected to the second wheel;

positioning the second brush in contact with the field; and, rotating the second brush at a second rotational speed dependent on the rotation of the second wheel and independent of the first rotational speed of said first brush sweeping litter off the field as the vehicle moves thereacross.

10. The method of claim 9 and comprising the further step of:

magnetically removing litter from the field as the vehicle moves thereacross; and, holding the removed litter.

11. The method of claim 10 and comprising the further step:

tilting the vehicle to insure the first brush and second brush are not in contact with the field until it is desired to sweep the field with the first brush and second brush.

12. A method of removing litter from a field comprising the steps of:

providing a vehicle having a first wheel and a second wheel to support the vehicle atop a field with the vehicle having a first brush and second brush both rotatably mounted thereon being connected respectively to the first wheel and to the second wheel and both engagable with the field, the vehicle further having a container assembly to hold litter;

positioning a first brush and a second brush on a vehicle in contact with a field having litter thereon;

moving the vehicle horizontally across the field;

rotating the first brush at a first rotational speed depending on the rotation of the first wheel sweeping litter off the field as the vehicle moves thereacross;

rotating the second brush at a second rotational speed depending on the rotation of the second wheel independent of the rotation of the first brush and the first wheel sweeping litter off the field as the vehicle moves thereacross; and, rotating the first brush and second brush past the container assembly to scrape and deposit litter on the first brush and second brush into the container assembly.

13. The method of claim 12 and comprising the further step of: vibrating the container assembly to separate litter according to a specified size.

* * * * *